US011317679B2

(12) United States Patent
Hu

(10) Patent No.: US 11,317,679 B2
(45) Date of Patent: May 3, 2022

(54) STRING COLLECTING DEVICE AND ARTICLE HAVING STRING

(71) Applicant: SHENZHEN FITGO TECHNOLOGY CO., LTD., Guangdong (CN)

(72) Inventor: Kaiyan Hu, ShenZhen (CN)

(73) Assignee: SHENZHEN FITGO TECHNOLOGY CO., LTD., Shenzhen (CN)

( * ) Notice: Subject to any disclaimer, the term of this patent is extended or adjusted under 35 U.S.C. 154(b) by 77 days.

(21) Appl. No.: 16/961,657

(22) PCT Filed: Dec. 26, 2019

(86) PCT No.: PCT/CN2019/128505
§ 371 (c)(1),
(2) Date: Jul. 10, 2020

(87) PCT Pub. No.: WO2021/120266
PCT Pub. Date: Jun. 24, 2021

(65) Prior Publication Data

US 2021/0186159 A1 Jun. 24, 2021

(30) Foreign Application Priority Data

Dec. 18, 2019 (CN) ..... 201911311853.6

(51) Int. Cl.
*A43C 11/16* (2006.01)
*A43C 1/06* (2006.01)
*A43C 3/00* (2006.01)

(52) U.S. Cl.
CPC ..... *A43C 11/165* (2013.01); *A43C 1/06* (2013.01); *A43C 3/00* (2013.01)

(58) Field of Classification Search
CPC ..... A43C 11/165; A43C 1/06; A43C 3/00
See application file for complete search history.

(56) References Cited

U.S. PATENT DOCUMENTS 5,042,177 A 8/1991 Schoch
8,353,088 B2 * 1/2013 Ha ..... A43B 3/0042 24/712.5

(Continued)

FOREIGN PATENT DOCUMENTS

CN 205432385 U 8/2016
CN 105982392 A 10/2016

(Continued)

OTHER PUBLICATIONS

EP Office Action in Application No. 19 908 075.5 dated Jul. 19, 2021.

(Continued)

*Primary Examiner* — David M Upchurch
(74) *Attorney, Agent, or Firm* — Maschoff Brennan

(57) ABSTRACT

The present disclosure provides a string collecting device and an article having a string, wherein the string collecting device includes a rotating part and a string winding part configured to wind a string; the rotating part is provided with at least one movable part that is capable of moving; the movable part is configured to be engaged with the string winding part when the rotating part is rotated towards a string collecting direction, and wherein when the movable part is engaged with the string winding part, the three, namely, the rotating part, the movable part and the string winding part, are connected in synchronous rotation.

19 Claims, 7 Drawing Sheets

(56) References Cited

U.S. PATENT DOCUMENTS

| | | | | |
|---|---|---|---|---|
| 2018/0160775 | A1* | 6/2018 | Pollack | B65H 75/4492 |
| 2019/0216176 | A1 | 7/2019 | Converse et al. | |

FOREIGN PATENT DOCUMENTS

| | | | |
|---|---|---|---|
| CN | 207220305 | U | 4/2018 |
| CN | 108354269 | A | 8/2018 |
| CN | 108451098 | A | 8/2018 |
| CN | 208403438 | U | 1/2019 |
| DE | 29503552 | U1 | 4/1995 |
| DE | 202019105576 | U1 | 11/2019 |
| EP | 3556239 | A1 | 10/2019 |
| EP | 3578069 | A | 12/2019 |
| KR | 10-2015-0131485 | A | 11/2015 |
| KR | 10-2017-0122462 | A | 11/2017 |
| WO | 2016/099070 | A1 | 6/2016 |

OTHER PUBLICATIONS

KR Office Action in Application No. 10-2020-7019880 dated Jul. 8, 2021.

KR Office Action in Application No. 10-2020-7019880 dated Jan. 24, 2022.

* cited by examiner

STRING COLLECTING DEVICE AND ARTICLE HAVING STRING

CROSS-REFERENCE TO RELATED APPLICATION

The present disclosure claims priority of Chinese Patent Application with the filing number 201911311853.6, filed on Dec. 18, 2019 with the Chinese Patent Office (CNIPA), and entitled "String Collecting Device and Article Having String", the contents of which are incorporated by reference herein in their entirety.

TECHNICAL FIELD

The present disclosure relates to the technical field of tying, in particular to a string collecting device and an article having a string.

BACKGROUND ART

Products such as shoes, clothes and medical protective gear are usually provided with strings, wherein a user may achieve a purpose of tightening or loosening the products by adjusting tightness of the string (or rope belt).

At present, adjustment of tightness of a string, especially the tightening of the string, needs to be completed by two hands, for example, when tying shoelace, the shoelace can be tightened only by pulling two ends of the shoelace respectively with two hands.

SUMMARY

An object of the present disclosure lies in providing a string collecting device and an article having a string so as to overcome the defects in the prior art and solve the problem in the prior art that the operation of tightening the string is cubersome.

In order to solve the above problem, the present disclosure provides a string collecting device, including a rotating part and a string winding part configured to wind a string;

wherein the rotating part is provided with at least one movable part that can be moved, and the movable part is configured to be engaged with the string winding part when the rotating part is rotated towards a string collecting direction;

wherein when the movable part is engaged with the string winding part, the rotating part, the at least one movable part and the string winding part are connected in synchronous rotation.

As a further improvement of the above technical solution, each movable part includes meshing teeth, and the string winding part is provided with a gear ring corresponding to the meshing teeth.

As a further improvement of the above technical solution, the rotating part is provided with a sliding groove, and the movable part is provided with an insertion portion; and the insertion portion is inserted into and slidably connected with the sliding groove.

As a further improvement of the above technical solution, the rotating part is provided with a toggle portion configured to drive the at least one movable part to move in a radial direction of the rotating part;

wherein each movable part includes a pull-out surface interacting with the toggle portion;

the toggle portion includes a pull-out structure, and the pull-out structure is configured to press the pull-out surface, when the rotating part is rotated towards the string collecting direction, so as to drive the movable part to be engaged with the string winding part;

the pull-out structure is provided on a central axis of the rotating part;

the pull-out structure includes at least one pressing portion in one-to-one correspondence with the at least one movable part, and each pressing portion is configured to press against the respective pull-out surface;

the toggle portion further includes a pull-back structure, and each movable part includes a pull-back surface arranged opposite to the pull-out surface;

the pull-back structure is configured to push and press the pull-back surface, when the rotating part is rotated towards a direction opposite to the string collecting direction, so as to drive the movable part to be separated from the string winding part; and the pull-back structure includes at least one pull-back block, which is in one-to-one correspondence with the at least one movable part.

As a further improvement of the above technical solution, the string winding part is rotatably disposed inside a fixing part, and the rotating part is sleeved on and rotatably connected with the fixing part.

As a further improvement of the above technical solution, the fixing part is provided thereon with a rotation restricting part configured to restrict the rotating part to be rotatable only in the string collecting direction;

wherein the rotation restricting part includes a ratchet wheel, and the rotating part is provided thereon with pawls corresponding to the ratchet wheel;

and the rotating part includes a rotary cover and a turnplate rotatably provided in the rotary cover.

As a further improvement of the above technical solution, the rotary cover is provided thereon with a driving portion configured to drive the turnplate to rotate in the string collecting direction;

the driving portion includes arc grooves, and the turnplate is provided thereon with protrusions which are coaxially arranged with and are in one-to-one correspondence with the arc grooves; and the protrusions are inserted into the arc grooves respectively, and by abutting against the protrusions, end portions of the arc grooves enable the turnplate to synchronously rotate with the rotary cover;

wherein a plurality of the arc grooves are provided and are distributed in an array which is annular about a central axis of the rotary cover.

As a further improvement of the above technical solution, the rotary cover is provided thereon with a snap-fit portion configured to be snap-fitted with the turnplate.

As a further improvement of the above technical solution, the snap-fit portion includes elastic hooks, and the turnplate is provided thereon with engagement grooves snap-fitted with the hooks respectively; and a plurality of the hooks are provided and distributed in an array which is annular about the central axis of the rotary cover.

The present disclosure further provides an article having a string, including the string and the string collecting device as described in the above.

The present disclosure brings about following beneficial effects: the string collecting device provided in the present disclosure includes the rotating part and the stringing winding part, when the user rotates the rotating part towards the string collecting direction, the at least one movable part will be engaged with the string winding part, at which time, the three, namely, the rotating part, the movable part and the string winding part are connected in synchronous rotation. It can thus be seen that when the rotating part is rotated towards the string collecting direction, the string winding part also will rotate towards the string collecting direction, thus completing the operation of tightening the string.

This string collecting device is simple in structure and easy in operation, wherein when the user needs to tighten the string, the operation can be completed just by rotating the rotating part with a single hand towards the string collecting direction.

BRIEF DESCRIPTION OF DRAWINGS

In order to more clearly illustrate technical solutions of embodiments of the present disclosure, accompanying drawings which need to be used in the embodiments will be introduced briefly below, and it should be understood that the accompanying drawings below merely show some embodiments of the present disclosure, therefore, they should not be considered as limitations on the scope, and those ordinarily skilled in the art still could obtain other relevant accompanying drawings according to these accompanying drawings, without using any creative effort.

Figure 1:
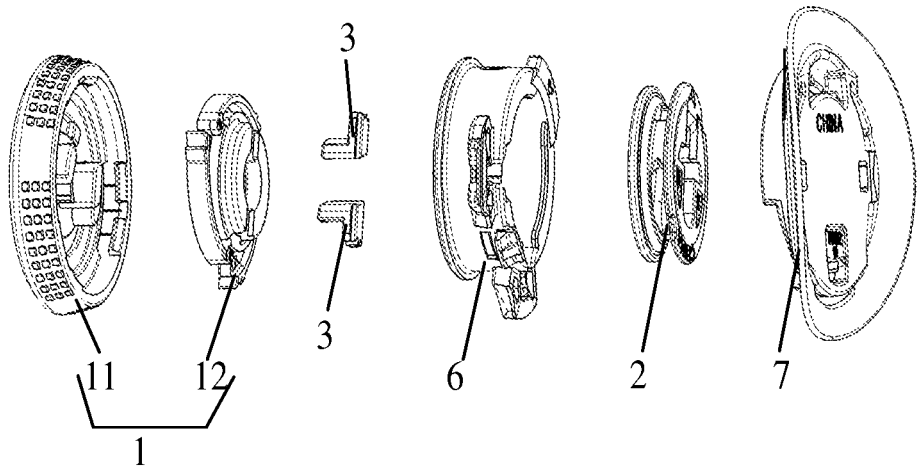
FIG. 1 shows an exploded view of a string collecting device.

Reference signs of main elements:

1—rotating part; 2—string winding part; 3—movable part; 4—meshing tooth; 5—gear ring; 6—fixing part; 7—sewing part; 8—string threading hole; 9—string inlet hole; 10—string groove; 11—rotary cover; 12—turnplate; 13—buckle; 14—brim; 15—first connecting portion; 16—second connecting portion; 17—insertion portion; 18—pull-out surface; 19—pull-back surface; 20—pull-out structure; 21—pull-back structure; 22—rotation restricting part; 23—pawl; 24—driving portion; 25—protrusion; 26—snap-fit portion; 27—engagement groove; 28—sliding groove; 29—insertion pin; 30—positioning pin; 31—insertion hole; 32—positioning slot; 33—pressing portion.

DETAILED DESCRIPTION OF EMBODIMENTS

Embodiments of the present disclosure are described in detail below, and examples of the embodiments are shown in the accompanying drawings, in which like or similar signs represent like or similar elements or elements having like or similar functions throughout the accompanying drawings. The embodiments described below with reference to the accompanying drawings are exemplary, and merely used to explain the present disclosure, but cannot be construed as limitation to the present disclosure.

In the description of the present disclosure, it should be understood that orientational or positional relations indicated by terms such as "center (central)", "longitudinal", "lateral", "length", "width", "thickness", "upper", "lower", "front", "back", "left", "right", "vertical", "horizontal", "top", "bottom", "inner", "outer", "clockwise", "anticlockwise", "axial", "radial", "circumferential" are based on orientational or positional relations as shown in the accompanying drawings, merely for facilitating the description of the present disclosure and simplifying the description, rather than indicating or implying that related devices or elements have to be in the specific orientation or configured and operated in a specific orientation, therefore, they should not be construed as limitation to the present disclosure.

Besides, terms "first" and "second" are merely for descriptive purpose, but should not be construed as indicating or implying importance in the relativity or suggesting the number of a related technical feature. Thus, a feature defined with "first" and "second" may explicitly or implicitly means that one or more such features are included. In the description of the present disclosure, "multiple (a plurality of)" means two or more, unless otherwise explicitly defined specifically.

In the present disclosure, unless otherwise specified and defined explicitly, terms such as "mount", "join", "connect" and "fix" should be construed in a broad sense. For example, a connection may be a fixed connection, a detachable connection, or an integral connection; it may be a mechanical connection, and also may be an electrical connection; it may be a direct connection, an indirect connection via an intermediary, or internal communication between two elements or interaction between two elements. For those ordinarily skilled in the art, specific meanings of the above-mentioned terms in the present disclosure can be understood according to specific circumstances.

In the present disclosure, unless otherwise specified and defined explicitly, a first feature being "above" or "below" a second feature may include the first feature and the second feature being in direct contact or the first feature and the second feature being in indirect contact through an intermediary. Moreover, the first feature being "on", "above" or "over" the second feature may be that the first feature is right above or not right above the second feature, or merely means that the level of the first feature is higher than that of the second feature. The first feature being "under", "below" or "beneath" the second feature may be that the first feature is directly below or not directly below the second feature, or merely means the level of the first feature being lower than that of the second feature.

Embodiment 1

Referring to FIG. 1, in the present embodiment, a string collecting device is provided, including a rotating part 1 and a string winding part 2 configured to wind a string. The rotating part 1 is provided thereon with at least one movable part 3 that can be moved, wherein the movable part 3 is configured to be engaged with the string winding part 2 when the rotating part 1 is rotated towards a string collecting direction. In the above, when the movable part 3 is engaged with the string winding part 2, the three, namely, the rotating part 1, the at least one movable part 3 and the string winding part 2, are synchronously in rotational connection.

After a user rotates the rotating part 1 by a certain angle towards the string collecting direction, the movable part 3 will be engaged with the string winding part 2, so as to enable the three, namely, the rotating part 1, the at least one movable part 3 and the string winding part 2 to be synchronously in rotational connection. It can thus be seen that when the rotating part 1 is rotated towards the string collecting direction, the string winding part 2 also will be rotated towards the string collecting direction, thus completing the operation of tightening the string.

In the present embodiment, two movable parts 3 may be provided in consideration of production cost, stability and other factors. In the above, the movable parts 3 may be distributed in an annular array about an axis of rotation of the rotating part 1.

However, in an actual production and manufacturing process, the number of the at least one movable part 3 may be set as desired, for example, one, three or four.

Figure 2:
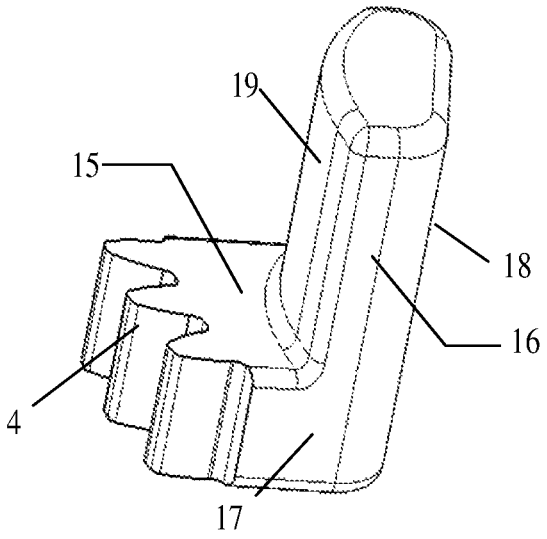
FIG. 2 shows a schematic view of a movable part.
Figure 3:
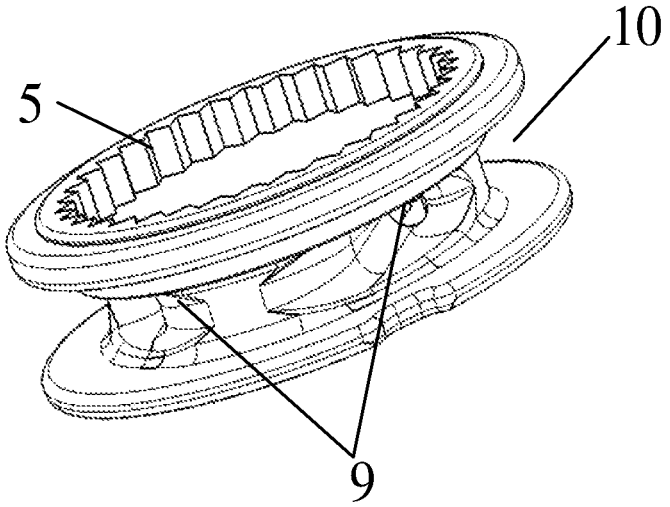
FIG. 3 shows a schematic view of a string winding part.

As shown in FIG. 2 and FIG. 3, each movable part 3 includes meshing teeth 4, and the string winding part 2 is provided with a gear ring (or tooth ring) 5 corresponding to the meshing teeth 4. In the above, the string winding part 2 may be provided with an internally toothed gear ring.

Figure 4:
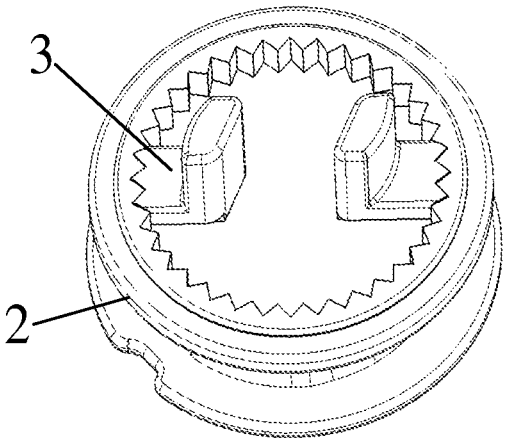
FIG. 4 shows a schematic view when the movable parts and the string winding part are engaged.

As shown in FIG. 4, when the movable parts 3 are engaged with the string winding part 2, the meshing teeth 4 will be kept in a meshed state with the gear ring 5, thus achieving a synchronous rotational connection between the movable parts 3 and the string winding part 2.

As shown in FIG. 1, in the present embodiment, besides the rotating part 1 and the string winding part 2, the string collecting device further includes a fixing part 6 and a sewing part 7, wherein the sewing part 7 is provided on the fixing part 6. In the above, the sewing part 7 and the fixing part 6 may be fixedly connected by snap-fitting, bonding or the like.

Figure 6:
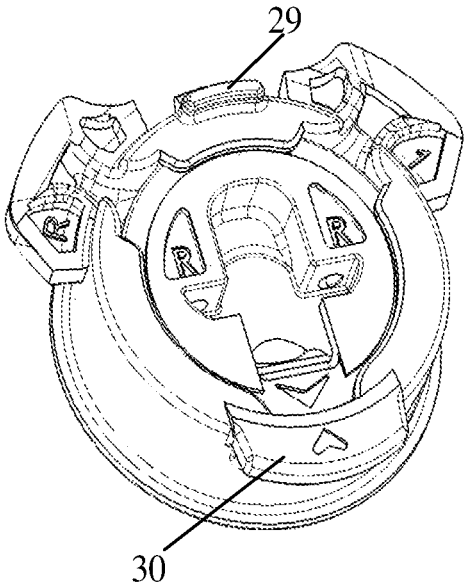
FIG. 6 shows a second isometric view of the fixing part.

As shown in FIG. 6, a bottom portion of the fixing part 6 may be provided with an insertion pin 29 and a positioning pin 30.

Figure 8:
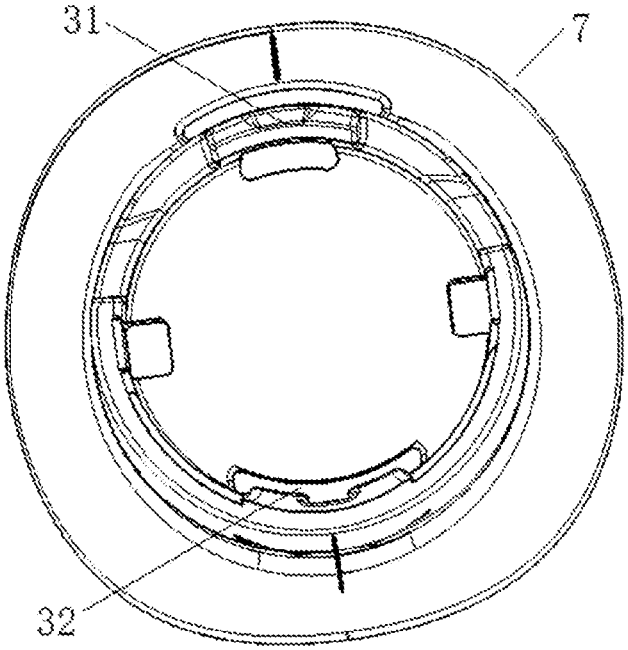
FIG. 8 shows a schematic view of a sewing part.

As shown in FIG. 8, the sewing part 7 may be provided in a circular shape as a whole, wherein the sewing part 7 may be made of plastic or other materials. In order to facilitate the connection between the fixing part 6 and the sewing part, the sewing part 7 may be provided with an insertion hole 31 corresponding to the insertion pin 29 and provided with a positioning slot 32 corresponding to the positioning pin 30, wherein during installation, the insertion pin 29 is inserted into the insertion hole 31 and the positioning pin 30 is inserted into the positioning slot 32.

Figure 7:
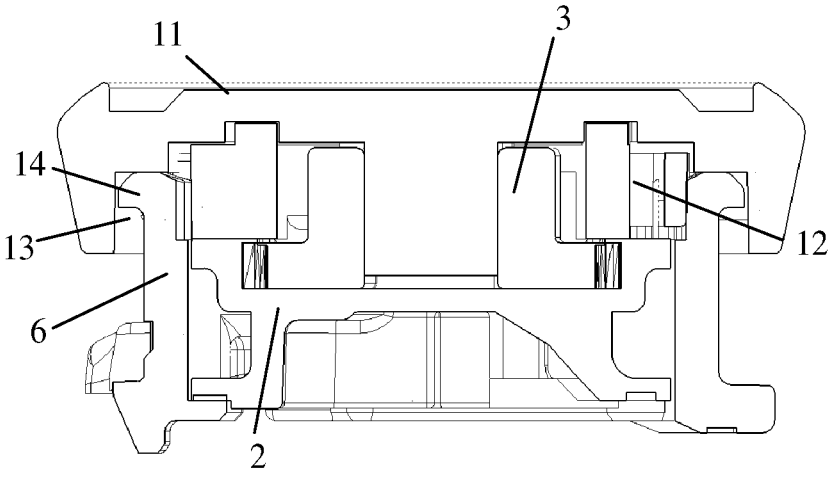
FIG. 7 shows a sectional view of the string collecting device.

As shown in FIG. 7, the string winding part 2 is rotatably disposed inside the fixing part 6, and the rotating part 1 is sleeved on and rotatably connected with the fixing part 6. In the above, the rotating part 1 and the sewing part 7 are disposed at a top portion and the bottom portion of the fixing part 6, respectively. The sewing part 7 is not shown in FIG. 7.

Figure 5:
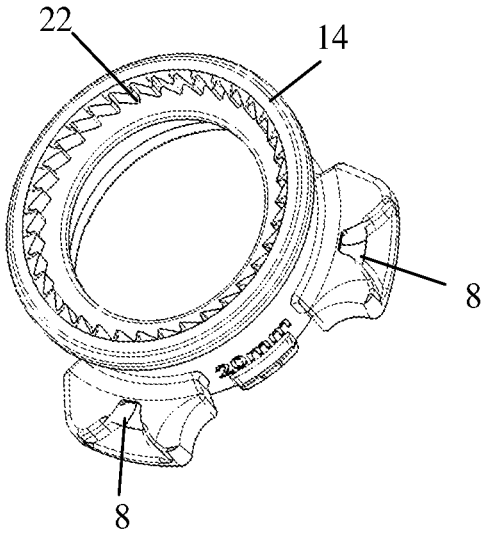
FIG. 5 shows a first isometric view of a fixing part.

As shown in FIG. 3 and FIG. 5, in order to facilitate the installation of the string, the fixing part 6 may be provided with string threading holes (holes for passing string therethrough) 8, and the string winding part 2 may be provided with string inlet holes 9 corresponding to the string threading holes 8 respectively. In the above, the string inlet holes 9 are arranged in a string groove 10 of the string winding part 2.

Figure 14:
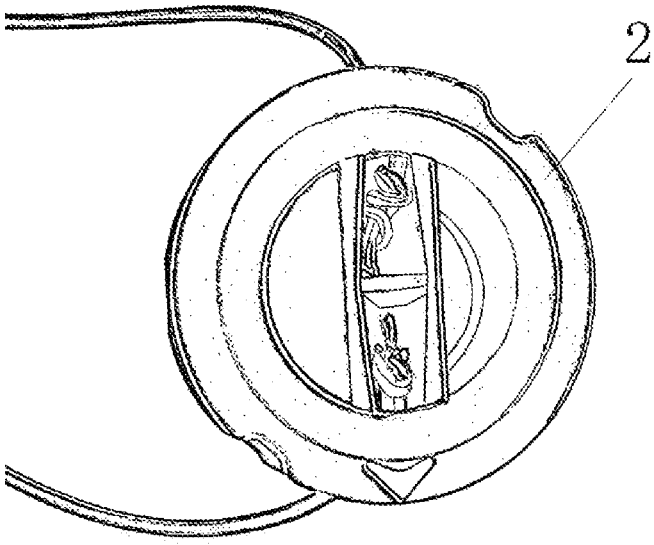
FIG. 14 shows a schematic view of connection between the string winding part and a string.

Referring to FIG. 14, after passing through the string threading holes 8 and the string inlet holes 9 in sequence, an end portion of the string is inserted into the inside of the string winding part 2; and the end portion of the string is extended out of an opening at a bottom portion of the string winding part 2, and then the end portion of the string is knotted such that the end portion becomes thick and cannot slip out of the string inlet hole 9. When the string is being wound, the string winding part 2 rotates relative to the fixing part 6, and the string will be wound on the string groove 10 on an outer side wall of the string winding part 2, thus the string can be tightened.

The string collecting device may be mounted to articles having strings such as shoes, backpacks, or medical protective gear by the sewing part 7 by gluing or by sewing with needle and thread and so on.

For the sake of easier understanding, component parts of the string collecting device are illustrated below.

Figure 9:
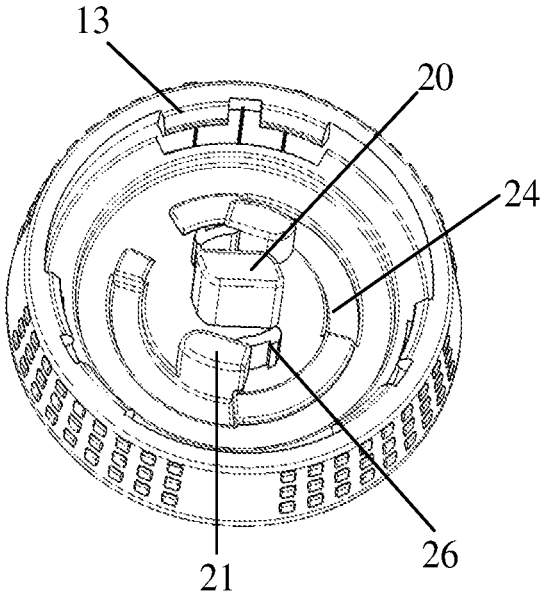
FIG. 9 shows a schematic view of a rotary cover.
Figure 10:
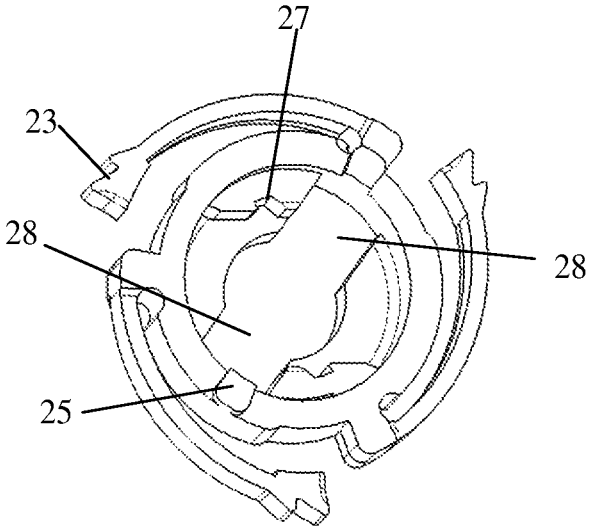
FIG. 10 shows a schematic view of a turnplate.

As shown in FIG. 9 and FIG. 10, in the present embodiment, the rotating part 1 includes a rotary cover 11 and a turnplate 12 which is rotatably provided in the rotary cover 11, wherein the turnplate 12 is rotatable relative to the rotary cover 11 within a certain range of angles. In the above, after the rotary cover 11 is rotated by a certain angle towards the string collecting direction, the rotary cover 11 will abut against the turnplate 12, so that the turnplate 12 rotates synchronously with the rotary cover 11.

As shown in FIG. 7, the rotary cover 11 is sleeved on the fixing part 6. The rotary cover 11 may be provided with an elastic buckle 13, and a top portion of the fixing part 6 may be provided with an annular brim (or convex edge) 14, wherein assembling between the rotary cover 11 and the fixing part 6 may be achieved just by buckling the buckle 13 on the brim 14.

As shown in FIG. 2, the movable part 3 includes a first connecting portion 15 and a second connecting portion 16, wherein the meshing teeth 4 are provided on the first connecting portion 15. The meshing teeth 4 and the second connecting portion 16 are respectively provided on two opposite sides of the first connecting portion 15.

The movable part 3 may be provided with an insertion portion 17, wherein the insertion portion 17 is provided in a bottom portion of the first connecting portion 15.

The second connecting portion 16 includes two opposite surfaces, which are a pull-out surface 18 and a pull-back surface 19. In the above, the pull-out surface 18 is a surface of the second connecting portion 16 remote from and facing away from the meshing teeth 4, and the pull-back surface 19 is a surface of the second connecting portion 16 close to and facing the meshing teeth 4.

In the present embodiment, the at least one movable part 3 may be made of plastic or hardware through processing and manufacturing, wherein the first connecting portion 15 and the second connecting portion 16 together form a one-piece structure.

As shown in FIG. 10, in order to realize movable connection between the movable part 3 and the string winding part 2, the turnplate 12 of the rotating part 1 may be provided thereon with sliding grooves 28.

The insertion portion 17 of the movable part 3 is inserted into and slidably connected with the sliding grooves 28. In the above, the sliding grooves correspond to the movable parts 3 one to one.

In the present embodiment, two sliding grooves 28 are provided, which are in one-to-one correspondence with the movable parts 3.

A central portion of the turnplate 12 is provided with a central through hole which is located between the two sliding grooves 28. As shown in FIG. 10, the central through hole communicates with the sliding grooves 28 on two sides thereof.

In the present embodiment, each movable part 3 is movable in a radial direction of the rotating part 1.

In order to drive the movable part 3 to move, and realize its engagement with and separation from the string winding part 2, in the present embodiment, the rotary cover 11 of the rotating part 1 may be provided with a toggle portion configured to drive the movable part 3 to move in a radial direction of the rotating part 1. In the above, when the rotary cover 11 is rotated towards the string collecting direction, the toggle portion interacts with the pull-out surface 18 of the movable part 3, so that the movable part 3 is driven to be engaged with the string winding part 2; and when the rotary cover 11 is rotated towards the direction opposite to the string collecting direction, the toggle portion interacts with the pull-back surface 19 of the movable part 3, thereby driving the movable part 3 to be separated from the string winding part 2.

As shown in FIG. 9, the toggle portion includes a pull-out structure 20, wherein when the rotary cover 11 is rotated towards the string collecting direction, the pull-out structure 20 presses against the pull-out surface 18 so as to drive the movable part 3 to be engaged with the string winding part 2.

The pull-out structure 20 may be provided on a central axis of the rotating part 1. In the above, when the turnplate 12 is mounted on the rotary cover 11, the pull-out structure 20 will be inserted into the central through hole of the turnplate 12.

In the present embodiment, the pull-out structure 20 includes pressing portions 33 which are in one-to-one correspondence with the movable parts 3, and the pressing portions 33 are configured to press against the pull-out surface 18. In the above, the pressing portions 33 are regarded as a whole, then on the pull-out structure 20, the pressing portions 33 are farthest from a center of the pull-out structure 20.

Figure 11:
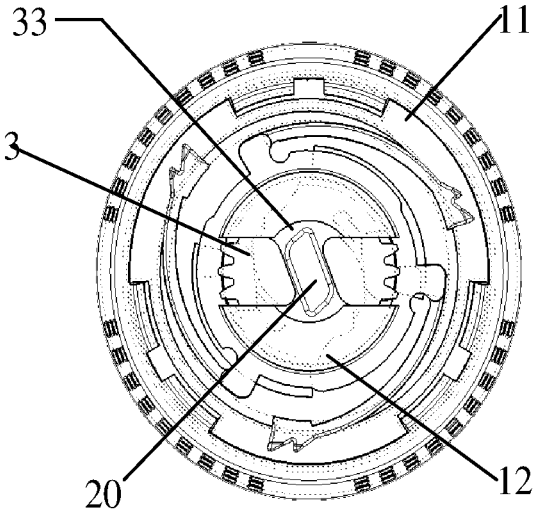
FIG. 11 shows a schematic view showing that pressing portions of a pull-out structure do not act on the movable parts.
Figure 12:
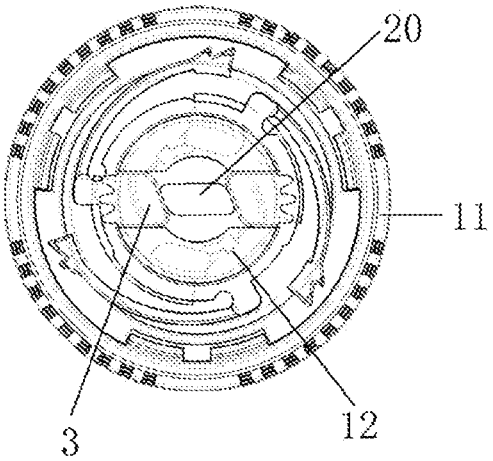
FIG. 12 shows a schematic view showing that the pressing portions of the pull-out structure act on the movable parts.

Referring to FIG. 11 and FIG. 12, an anticlockwise direction in the drawings is the string collecting direction.

When the rotating part 1 is rotated towards the anticlockwise direction, an end surface of the pressing portion 33 will be attached to the pull-out surface 18 and thereby drive the movable part 3 to move until the meshing teeth 4 of the movable parts 3 are meshed with the gear ring 5. After the meshing teeth 4 are meshed with the gear ring 5, the movable parts 3 cannot continue moving because of restriction by the gear ring 5, so that the three, namely, the pull-out structure 20, the movable parts 3 and the gear ring 5, are in a relatively static state.

In the present embodiment, the cross section of the pull-out structure 20 may be set to be a parallelogram in consideration of the number of movable parts 3, the manufacturing cost and so on. Thus, the pull-out structure 20 has two opposite side surfaces which are in one-to-one correspondence with the movable parts 3.

In the above, in order to ensure the tightness of the attachment between the pull-out surface 18 and the end surface of the pressing portion 33, the pull-out surface 18 may be set as a flat surface.

As shown in FIG. 11 and FIG. 12, a distance between the pull-out surface 18 and the central axis of the rotating part 1 increases gradually in the string collecting direction. Correspondingly, in order to correspond to the pull-out surface 18, the distance between the end surface of the pressing portion 33 and the central axis of the rotating part is gradually reduced in the string collecting direction, so that the cross section of the pull-out structure 20 is a nonrectangular parallelogram, and in FIG. 11, a lowermost angle of the cross section of the pull-out structure 20 is an acute angle.

In this way, it facilitates the attachment between the end surface of the pressing portion 33 and the pull-out surface 18; meanwhile, once the end surface of the pressing portion 33 is attached to the pull-out surface 18, if the rotary cover 11 is continuously rotated towards the string collecting direction, the end surface of the pressing portion 33 will be attached to the pull-out surface 18 more closely and they won't be separated from each other.

It should be noted that, in the actual manufacturing process, as the number of movable parts 3 changes, the shape of the pull-out structure 20 also needs to be adjusted correspondingly.

As shown in FIG. 9, the toggle portion further includes a pull-back structure 21, and the movable part 3 further includes the pull-back surface 19 arranged opposite to the pull-out surface 18. In the above, when the rotary cover 11 of the rotating part 1 is rotated towards the direction opposite to the string collecting direction, the pull-back structure 21 pushes and presses the pull-back surface 19 so as to drive the movable part 3 to be separated from the string winding part 2.

The pull-back structure 21 may include pull-back blocks, which are in one-to-one correspondence with the movable parts 3.

Figure 13:
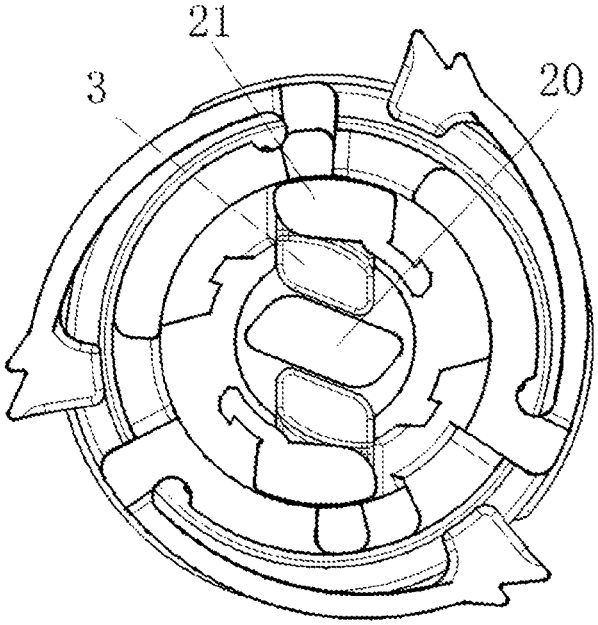
FIG. 13 shows a schematic view showing that a pull-back structure acts on the movable parts.

As shown in FIG. 13, when the movable parts 3 are separated from the string winding part 2, an inner side of each pull-back block will push and press the pull-back surface 19 of the respective movable part 3, so that the movable part 3 is moved. In the above, in order to make the contact between the pull-back block and the movable part 3 smoother, an arc guide surface is provided on the inner side of the pull-back block, and correspondingly, the pull-back surface 19 may be provided as an arc surface.

When the user needs to loosen the string, the rotary cover 11 can be rotated towards the direction opposite to the string collecting direction, so that the pressing portion 33 is separated from the pull-out surface 18, thus realizing the separation of the movable part 3 from the string winding part 2. At this time, the user may loosen the string by pulling the string to reversely rotate the string winding part 2.

As shown in FIG. 5, the fixing part 6 is provided thereon with a rotation restricting part 22 configured to restrict the rotating part 1 to be rotatable only in the string collecting direction.

As shown in FIG. 5 and FIG. 10, the rotation restricting part 22 may be a ratchet wheel, and correspondingly, the turnplate 12 of the rotating part 1 is provided thereon with pawls (or ratchets) 23 corresponding to the ratchet wheel. In the above, the pawls 23 may be elastic. Thus, when the rotary cover 11 is rotated reversely, no relative rotation may occur between the turnplate 12 and the fixing part 6.

When the rotary cover 11 is rotated towards the string collecting direction, the turnplate 12 is required to move synchronously with the rotary cover to complete the operation of tightening the string. It is because that only when the turnplate 12 is rotated, the movable parts 3 slidably provided on the turnplate 12 can rotate, thereby realizing the rotation of the string winding part 2.

The rotary cover 11 is provided thereon with a driving portion 24 configured to drive the turnplate 12 to rotate in the string collecting direction.

As shown in FIG. 9 and FIG. 10, the driving portion 24 may include arc grooves, and the turnplate 12 is provided thereon with protrusions 25 which are coaxially arranged with and are in one-to-one correspondence with the arc grooves. In the above, the protrusions 25 are inserted into the arc grooves respectively, and end portions of the arc grooves enable the turnplate 12 to synchronously rotate with the rotary cover 11 by abutting against the respective protrusions 25.

When the rotary cover 11 is rotated, and the protrusions 25 are moved to reach the end portions of the respective arc grooves, the end portions of the arc grooves will abut against the protrusions 25, thereby pushing the protrusions 25 to rotate, and realizing the synchronous rotation of the turnplate 12 and the rotary cover 11.

A plurality of arc grooves may be provided and distributed in an annular array about a central axis of the rotary cover 11. Thus, the driving force from the rotary cover 11 to the turnplate 12 can be more stable and balanced, thus avoiding the situation that a single protrusion 25 is broken due to excessive stress.

During daily use, in order to avoid looseness between the rotary cover 11 and the turnplate 12 caused by movement or vibration, the rotary cover 11 is provided thereon with a snap-fit portion 26 configured to be snap-fitted with the turnplate 12.

When no external force is applied, the end surface of the pressing portion 33 and the pull-out surface 18 are kept in an attached state with each other by the action of the snap-fit portion 26. Only when the rotary cover 11 is rotated reversely, the snap-fit portion 26 of the rotary cover 11 is separated from the turnplate 12.

As shown in FIG. 9 and FIG. 10, in the present embodiment, the snap-fit portion 26 may include elastic hooks, and the turnplate 12 is provided thereon with engagement grooves 27 snap-fitted with the hooks. In the above, a plurality of hooks are provided and distributed in an annular array about a central axis of the rotary cover 11.

When the engagement grooves 27 are processed, attention needs to be paid to the orientation of an entrance of each engagement groove 27, so that the respective hook can be inserted into and snap-fitted with the engagement groove 27 from the entrance of the engagement groove 27 only when the rotary cover 11 is rotated towards the string collecting direction.

In order to save the space inside the rotary cover 11 and facilitate the processing, the hooks can be integrally molded with the pull-back blocks.

In the present embodiment, an article having a string is further provided, including a string and the string collecting device described in the text above.

In the above, the article having a string includes shoes, backpacks, medical protective gear and so on.

In the description of the present description, descriptions with reference to terms such as "one embodiment", "some embodiments", "example", "specific example" or "some examples" indicate that specific features, structures, materials or characteristics described in combination with this embodiment or example are included in at least one embodiment or example of the present disclosure. In the present description, exemplary expressions of the above terms do not necessarily refer to the same embodiment or example. Moreover, the specific features, structures, materials or characteristics described can be combined in any appropriate manner in any one or more embodiments or examples. Besides, a person skilled in the art could compound and combine different embodiments or examples and features of different embodiments or examples described in the present description, without contradiction.

Although the embodiments of the present disclosure have been shown and described above, it could be understood that the above embodiments are exemplary, and should not be construed as limitation to the present disclosure, and those ordinarily skilled in the art could change, modify, substitute and vary the above embodiments within the scope of the present disclosure.

What is claimed is:

1. A string collecting device, comprising a rotating part and a string winding part configured to wind a string, wherein the rotating part is provided with at least one movable part that can be moved, and each movable part is configured to be engaged with the string winding part when the rotating part is rotated towards a string collecting direction, wherein when the movable part is engaged with the string winding part, the rotating part, the at least one movable part and the string winding part are connected to be in synchronous rotation, wherein the rotating part is provided with a toggle portion configured to drive the at least one movable part to move in a radial direction of the rotating part, wherein each movable part comprises a pull-out surface interacting with the toggle portion;

the toggle portion comprises a pull-out structure, and the pull-out structure is configured to press the pull-out surface, when the rotating part is rotated towards the string collecting direction, so as to drive the movable part to be engaged with the string winding part;

the pull-out structure is provided on a central axis of the rotating part;

the pull-out structure comprises at least one pressing portion which is in one-to-one correspondence with the at least one movable part, and each pressing portion is configured to press against the respective pull-out surface;

the toggle portion further comprises a pull-back structure, and the movable part comprises a pull-back surface arranged opposite to the pull-out surface;

the pull-back structure is configured to push and press the pull-back surface, when the rotating part is rotated towards a direction opposite to the string collecting direction, so as to drive the at least one movable part to be separated from the string winding part; and the pull-back structure comprises at least one pull-back block, which is in one-to-one correspondence with the movable part.

2. The string collecting device according to claim 1, wherein each movable part comprises meshing teeth, and the string winding part is provided with a gear ring corresponding to the meshing teeth.

3. The string collecting device according to claim 1, wherein the rotating part is provided with a sliding groove, and the movable part is provided with an insertion portion, wherein the insertion portion is inserted into and slidably connected with the sliding groove.

4. The string collecting device according to claim 1, wherein the string winding part is rotatably disposed inside a fixing part, and the rotating part is sleeved on and rotatably connected with the fixing part.

5. The string collecting device according to claim 4, wherein the fixing part is provided thereon with a rotation restricting part configured to restrict the rotating part such that the rotating part is rotatable only in the string collecting direction, wherein the rotation restricting part comprises a ratchet wheel, and the rotating part is provided thereon with pawls corresponding to the ratchet wheel; and the rotating part comprises a rotary cover and a turnplate rotatably provided in the rotary cover.

6. The string collecting device according to claim 5, wherein the rotary cover is provided thereon with a driving portion configured to drive the turnplate to rotate in the string collecting direction, wherein the driving portion comprises arc grooves, and the turnplate is provided thereon with protrusions which are coaxially arranged with and are in one-to-one correspondence with the arc grooves; and the protrusions are inserted into the arc grooves respectively, and by abutting against the respective protrusions, end portions of the arc grooves enable the turnplate to synchronously rotate with the rotary cover, wherein a plurality of the arc grooves are provided and distributed in an array which is annular about a central axis of the rotary cover.

7. The string collecting device according to claim 5, wherein the rotary cover is provided thereon with a snap-fit portion configured to be snap-fitted with the turnplate.

8. The string collecting device according to claim 7, wherein the snap-fit portion comprises elastic hooks, and the turnplate is provided thereon with engagement grooves which are snap-fitted with the hooks respectively; and a plurality of the hooks are provided and distributed in an array which is annular about a central axis of the rotary cover.

9. An article having a string, comprising the string and the string collecting device according to claim 1.

10. The string collecting device according to claim 2, wherein the rotating part is provided with a toggle portion configured to drive the at least one movable part to move in a radial direction of the rotating part, wherein each movable part comprises a pull-out surface interacting with the toggle portion;

the toggle portion comprises a pull-out structure, and the pull-out structure is configured to press the pull-out surface, when the rotating part is rotated towards the string collecting direction, so as to drive the movable part to be engaged with the string winding part;

the pull-out structure is provided on a central axis of the rotating part;

the pull-out structure comprises at least one pressing portion which is in one-to-one correspondence with the at least one movable part, and each pressing portion is configured to press against the respective pull-out surface;

the toggle portion further comprises a pull-back structure, and the movable part comprises a pull-back surface arranged opposite to the pull-out surface;

the pull-back structure is configured to push and press the pull-back surface, when the rotating part is rotated towards a direction opposite to the string collecting direction, so as to drive the at least one movable part to be separated from the string winding part; and the pull-back structure comprises at least one pull-back block, which is in one-to-one correspondence with the movable part.

11. The string collecting device according to claim 3, wherein the rotating part is provided with a toggle portion configured to drive the at least one movable part to move in a radial direction of the rotating part, wherein each movable part comprises a pull-out surface interacting with the toggle portion;

the toggle portion comprises a pull-out structure, and the pull-out structure is configured to press the pull-out surface, when the rotating part is rotated towards the string collecting direction, so as to drive the movable part to be engaged with the string winding part;

the pull-out structure is provided on a central axis of the rotating part;

the pull-out structure comprises at least one pressing portion which is in one-to-one correspondence with the at least one movable part, and each pressing portion is configured to press against the respective pull-out surface;

the toggle portion further comprises a pull-back structure, and the movable part comprises a pull-back surface arranged opposite to the pull-out surface;

the pull-back structure is configured to push and press the pull-back surface, when the rotating part is rotated towards a direction opposite to the string collecting direction, so as to drive the at least one movable part to be separated from the string winding part; and the pull-back structure comprises at least one pull-back block, which is in one-to-one correspondence with the movable part.

12. The article according to claim 9, wherein each movable part comprises meshing teeth, and the string winding part is provided with a gear ring corresponding to the meshing teeth.

13. The article according to claim 9, wherein the rotating part is provided with a sliding groove, and the movable part is provided with an insertion portion, wherein the insertion portion is inserted into and slidably connected with the sliding groove.

14. The article according to claim 9, wherein the rotating part is provided with a toggle portion configured to drive the at least one movable part to move in a radial direction of the rotating part, wherein each movable part comprises a pull-out surface interacting with the toggle portion;

the toggle portion comprises a pull-out structure, and the pull-out structure is configured to press the pull-out surface, when the rotating part is rotated towards the string collecting direction, so as to drive the movable part to be engaged with the string winding part;

the pull-out structure is provided on a central axis of the rotating part;

the pull-out structure comprises at least one pressing portion which is in one-to-one correspondence with the at least one movable part, and each pressing portion is configured to press against the respective pull-out surface;

the toggle portion further comprises a pull-back structure, and the movable part comprises a pull-back surface arranged opposite to the pull-out surface;

the pull-back structure is configured to push and press the pull-back surface, when the rotating part is rotated towards a direction opposite to the string collecting direction, so as to drive the at least one movable part to be separated from the string winding part; and the pull-back structure comprises at least one pull-back block, which is in one-to-one correspondence with the movable part.

15. The article according to claim 9, wherein the string winding part is rotatably disposed inside a fixing part, and the rotating part is sleeved on and rotatably connected with the fixing part.

16. The article according to claim 15, wherein the fixing part is provided thereon with a rotation restricting part configured to restrict the rotating part such that the rotating part is rotatable only in the string collecting direction, wherein the rotation restricting part comprises a ratchet wheel, and the rotating part is provided thereon with pawls corresponding to the ratchet wheel; and the rotating part comprises a rotary cover and a turnplate rotatably provided in the rotary cover.

17. The article according to claim 16, wherein the rotary cover is provided thereon with a driving portion configured to drive the turnplate to rotate in the string collecting direction, wherein the driving portion comprises arc grooves, and the turnplate is provided thereon with protrusions which are coaxially arranged with and are in one-to-one correspondence with the arc grooves; and the protrusions are inserted into the arc grooves respectively, and by abutting against the respective protrusions, end portions of the arc grooves enable the turnplate to synchronously rotate with the rotary cover, wherein a plurality of the arc grooves are provided and distributed in an array which is annular about a central axis of the rotary cover.

18. The article according to claim 16, wherein the rotary cover is provided thereon with a snap-fit portion configured to be snap-fitted with the turnplate.

19. The article according to claim 18, wherein the snap-fit portion comprises elastic hooks, and the turnplate is provided thereon with engagement grooves which are snap-fitted with the hooks respectively; and a plurality of the hooks are provided and distributed in an array which is annular about a central axis of the rotary cover.

* * * * *